US005601398A

United States Patent [19]

Treiber et al.

[11] Patent Number: 5,601,398

[45] Date of Patent: Feb. 11, 1997

[54] FUEL PUMP INCLUDING AXIALLY MOVABLE END COVERS FOR FEEDING FUEL FROM A SUPPLY TANK TO AN INTERNAL ENGINE

[75] Inventors: Juergen Treiber, Bamberg; Kurt Frank, Schorndorf; Werner Schmid, Tamm, all of Germany

[73] Assignee: Robert Bosch GmbH, Stuttgart, Germany

[21] Appl. No.: 548,843

[22] Filed: Oct. 26, 1995

[30] Foreign Application Priority Data

Oct. 26, 1994 [DE] Germany ..... 44 38 249.9

[51] Int. Cl.[6] ..... F04D 29/42; F04D 5/00; F02M 37/04

[52] U.S. Cl. ..... 415/55.1; 415/140; 415/214.1

[58] Field of Search ..... 415/55.1, 140, 415/214.1

[56] References Cited

U.S. PATENT DOCUMENTS

| | | | |
|---|---|---|---|
| 2,748,714 | 6/1956 | Henry | 415/140 |
| 2,997,957 | 8/1961 | Hall | 415/214.1 |
| 3,200,755 | 8/1965 | Mileti | 415/140 |
| 3,392,675 | 7/1968 | Taylor | 415/140 X |
| 4,865,517 | 9/1989 | Beechler | 415/214.1 |

FOREIGN PATENT DOCUMENTS

89113020 U 5/1991 Germany .

*Primary Examiner*—F. Daniel Lopez
*Assistant Examiner*—Michael S. Lee
*Attorney, Agent, or Firm*—Edwin E. Greigg; Ronald E. Greigg

[57] ABSTRACT

An assembly for feeding fuel form a supply tank to an internal combustion engine, with a feed pump which is designed as a flow pump and the disk-shaped impeller of which rotates in rotation in a cylindrical pump chamber delimited by a suction cover and by an intermediate housing bearing on the latter and at the same time feeds fuel from a suction port in a suction cover to a delivery port in the intermediate housing to enlarge the production tolerances of a fit between the suction cover (7) on the intermediate housing, and in order to allow the two pump components to lift off from one another during the operation of the feed pump in order to flush out dirt particles from the pump chamber, the suction cover and the intermediate housing are braced relative to one another by means of a resilient connecting element and the suction cover and intermediate housing are permitted to move relative to each other in order to flush dirt from an area of the pump impeller.

12 Claims, 2 Drawing Sheets

FUEL PUMP INCLUDING AXIALLY MOVABLE END COVERS FOR FEEDING FUEL FROM A SUPPLY TANK TO AN INTERNAL ENGINE

STATE OF THE ART

The invention proceeds from an assembly for feeding fuel from a supply tank to an internal combustion engine. In a feed assembly of this type, known from German utility model G 89 113 020, the impeller of a feed pump designed as a flow pump is driven in rotation by an electric drive motor arranged together with the latter in a common housing. The impeller has a plurality of blades which rotates in a cylindrical pump chamber, and includes recesses between the blades. In the axial end faces of the housing groove-shaped recesses are provided which lead from a suction port into the pump chamber to a delivery port and from the delivery parts, a feed duct in combination with the recesses between the blades on the impeller, feed the fuel from the suction port to the delivery port and at the same time increases the fuel pressure.

The pump chamber of the feed pump is, in this case, delimited in the axial direction by a suction cover connected to a suction connection into the supply tank and by an intermediate housing having the delivery port in a delivery space in the housing of the feed assembly, between which suction cover and which intermediate housing is clamped, moreover, an intermediate ring which delimits in the radial direction the cylindrical pump chamber receiving the impeller.

At the same time, the suction cover, intermediate ring and intermediate housing on the known feed assembly are connected rigidly to one another and retained firmly on the housing of the feed assembly, so that the disadvantage of the feed pump of the known feed assembly is that high production accuracy is necessary in order to seal off the pump chamber reliably. Furthermore, particularly when plastic components are used, there is the problem that the possible swelling of these cannot be compensated, and this can lead to increased leakage losses or a running of the impeller on the end walls of the pump chamber. Furthermore, on the known feed assembly, there is the risk that the impeller of the feed pump will be jammed if dirt particles or particles caused by abrasion which are present in the fuel settle in the narrow axial gap between the impeller and the end walls of the pump chamber.

ADVANTAGES OF THE INVENTION

In contrast to this, the advantage of the feed assembly according to the invention, is that a jamming of the impeller of the feed pump in the pump chamber can be reliably avoided. This is achieved in a constructively simple way by means of a resilient connecting element which braces the pump components, namely the suction cover and intermediate housing, relative to one another in such a way that, under specific conditions of pressure or of force within the pump chamber, it becomes possible for them to lift off axially from one another, so that a specific maximum pressure in the pump chamber is not exceeded (pressure relief valve) and dirt particles can be flushed out of the pump chamber. Moreover, because the pump components are braced according to the invention, the production outlay can be reduced in terms of the tolerances, since, even if plastic parts possibly swell, the pump components are reliably pressed against one another, so that the leakage loss out of the pump chamber is slight, thereby consequently increasing the efficiency of the feed pump. At the same time, according to the two exemplary embodiments shown, it is possible to cause the spring element to act against the suction cover or the intermediate housing, in each case the other pump component then being connected fixedly as an abutment to the housing of the feed assembly. The pump chamber can be arranged either in the suction cover or in the intermediate housing. The version with a spring element acting on the axially displaceable intermediate housing has the advantage, moreover, that the pressing force is assisted, during the operation of the feed pump, by the pressure in the delivery space adjoining the intermediate housing. The spring element is inserted into the feed assembly under pretension which is advantageously coordinated in such a way that it is slightly higher than the maximum permissible operating pressure in the pump chamber. A further advantage is achieved by the provision of an annular extension on one of the pump-chamber walls, preferably the suction cover, in the radially outer region of the end wall of the pump chamber, said annular extension having the size of half the axial play between the impeller and pump-chamber walls and thus allowing a uniform play distribution on both sides of the impeller. Further advantages and advantageous embodiments of the subject of the invention can be taken from the description, the drawing and the claims.

BRIEF DESCRIPTION OF THE DRAWINGS

Two exemplary embodiments of the assembly according to the invention for feeding fuel from a supply tank to an internal combustion engine are represented in the drawing and are explained in more detail in the following description.

DESCRIPTION OF THE EXEMPLARY EMBODIMENTS

Figure 1:
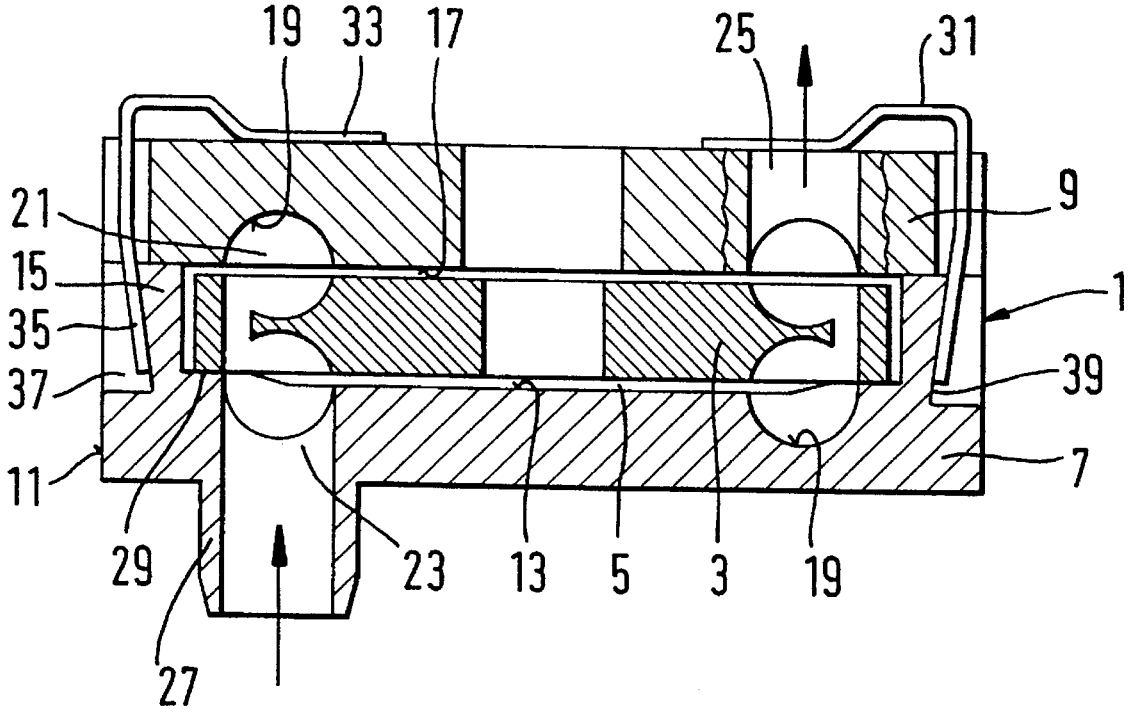
FIG. 1 shows a first exemplary embodiment, in which the spring element acts on the intermediate housing of the feed pump.

The description of the feed assembly according to the invention is restricted to the description of the feed pump essential to the invention, which is represented in the drawing and which is inserted into a housing of the feed assembly in a way known from the state of the art (for example, G 89 113 020) and is driven in rotation by an electric drive motor, the housing being connected by means of a suction connection to a supply tank and by means of a feed conduit to the internal combustion engine to be supplied.

The feed pump 1 of the flow-pump type, represented in FIG. 1, has a disk-shaped impeller 3 which is driven in rotation by an electric drive motor, not shown, and has a plurality of blades and rotates in a cylindrical pump chamber 5. The pump chamber 5 is delimited in the axial direction relative to the impeller 3 by a suction cover 7 and an intermediate housing 9 bearing on the latter, the disk-shaped suction cover 7 being fastened by means of its outer circumference 11 to a housing of the feed assembly, said housing not being shown in more detail in FIG. 1. The suction cover 7 has a cylindrical recess which forms a pump chamber 5 and the end face of which forms a first pump-chamber wall 13. The ring 15 obtained thereby and projecting axially in the direction of the intermediate housing 9 delimits the pump chamber 5 in the radial direction by means of its inner wall face, the likewise preferably disk-shaped intermediate housing 9 coming to bear on its ring end face by means of an end face forming a second pump-chamber wall 17. Grooves 19 extending in the form of a part ring are worked into the pump-chamber walls 13 and 17 and, in cooperation with the recesses between the blades of the impeller 3, in each case form a feed duct 21 which extends from a suction port 23 in the suction cover 7 to a delivery port 25 in the intermediate housing 9. The suction port 23 is connected to the fuel supply tank by means of a suction connection 27 on the suction cover 7, and on the other hand the delivery port 25 opens into a delivery space which adjoins the intermediate housing 9 on the end face facing away from the suction cover 7 and from which a feed conduit, not shown, leads off to the internal combustion engine.

Moreover, on the radially outer diametral region of the first pump-chamber wall 13, there is provided on the suction cover 7 an annular shoulder 29 which has the size of half the axial play of the impeller 3 relative to the pump-chamber walls 13, 17 and which thus forms a separate running region, on which the impeller 3 bears with its outermost region. At the same time, in the first exemplary embodiment, the connection of the suction cover 7 to the intermediate housing 9 is made by means of a spring clip 31 which keeps the axially displaceable intermediate housing 9 pressed against the fixed suction cover 7. In this case, both the one-piece clip, designed as an angled disk with a passage orifice for the drive shaft, and a plurality of two-armed angled sheet-metal strips can be used as a spring clip 31, in each case a first arm 33 bearing with a specific pretension on the end face of the intermediate housing 9 facing away from the pump chamber 5 and a second arm 35 engaging into a recess 37 on the circumferential surface of the suction cover 7, this second arm 35 having a play relative to the circumferential surface of the intermediate housing 9. The pocket-shaped recesses 37 deepen continuously in the direction facing away from the intermediate housing 9, so as to form an oblique bearing face 39, on which the second arms 35 in each case bear under pretension.

Figure 2:
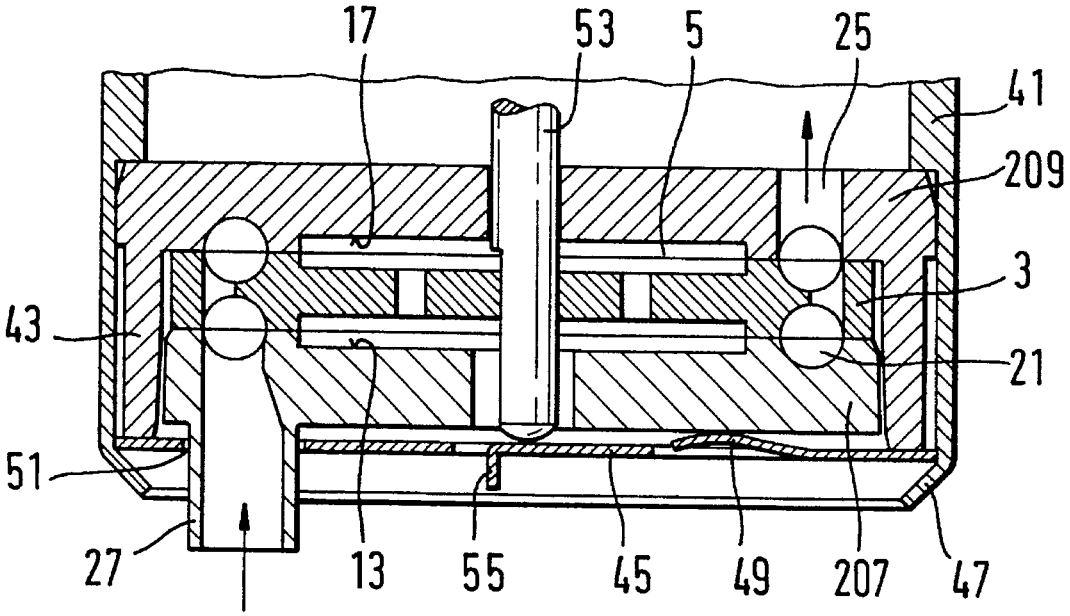
FIG. 2 is a second exemplary embodiment with a spring element acting on the suction cover.

In the second exemplary embodiment, which is represented in FIG. 2 and which corresponds in its basic design to the first exemplary embodiment, the intermediate housing 209 is firmly connected by means of its circumferential surface to the housing 41 of the feed assembly and the suction cover 207 is axially displaceable. For this purpose, there, the pump chamber 5 is worked into the intermediate housing 209 and the disk-shaped suction cover 207 projects into the cylindrical recess of the intermediate housing 209 forming the pump chamber 5, in such a way that said suction cover closes said recess axially, only a slight play remaining between the circumferential surface of the suction cover 207 and the inner wall face of the remaining annular extension 43 of the intermediate housing 209. At the same time, it is advantageous to make that region of the inner wall face of the annular extension 43 acting as a sealing face slightly conical, so that the orifice cross section between the suction cover 207 and the annular extension 43 increases with an increasingly lifted-off suction cover 207, in order, in the case of a specific pump-chamber pressure, to allow dirt particles to flow off unimpeded out of the pump chamber 5.

In the second exemplary embodiment, the resilient connecting element bracing the pump components relative to one another is designed as a spring washer 45 which is firmly clamped by means of an outer annular region between a collar 47 of the housing 41 and the end face of the annular extension 43.

Figure 3:
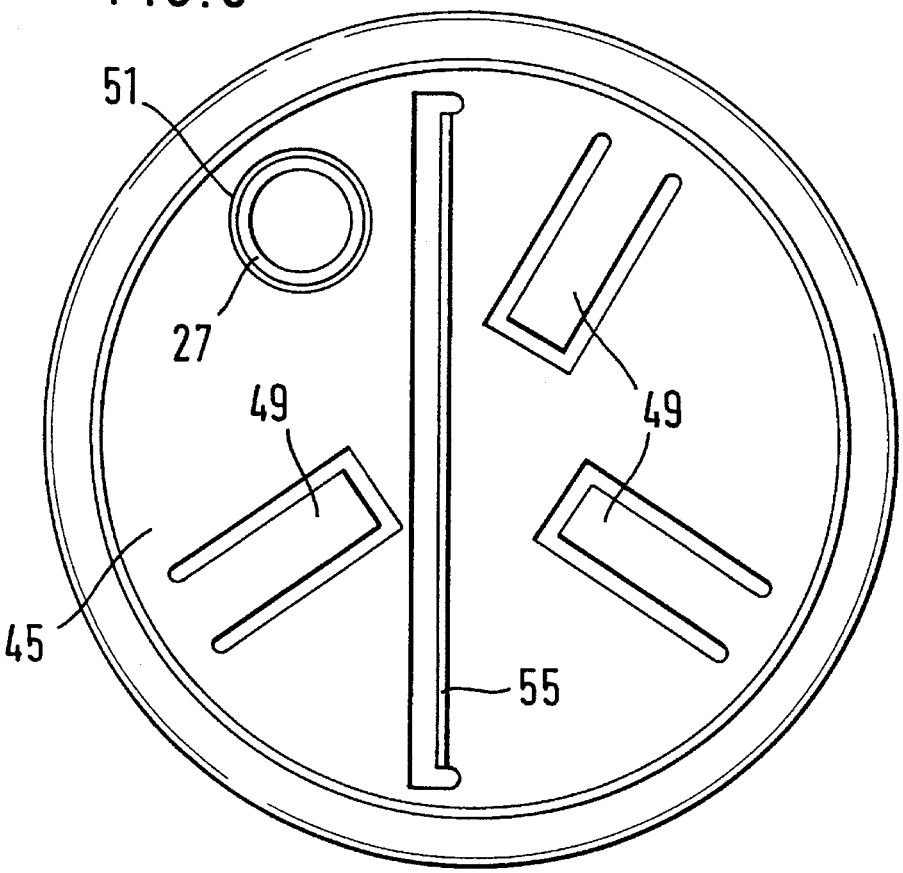
FIG. 3 is a view of the spring element used in FIG. 2.

As also represented in FIG. 3, the spring washer 45 has, on the end face facing the suction cover 207, a plurality of, preferably three, axially projecting spring tongues 49 which, in the installed state, bear with a specific pretensioning force on the suction cover 207 and thus brace the latter with a specific force via the impeller 3 against the intermediate housing 209. The pressure force of the spring tongues 49 is made only slightly higher than the force acting on the chamber walls 13, 17 as a result of the operating pressure in the pump chamber 5.

For leading through the suction connection 27, the spring washer 45 has a passage orifice 51 and, for supporting the drive shaft 53, a rib 55 on its end face facing away from the feed pump 1.

While the feed assembly is in operation, fuel is sucked in a known way into the pump chamber 5 via the suction port 23 and, as a result of the rotating impeller 3, is fed via the feed conduit 21 to the delivery port 25, via which the fuel passes with increased pressure into the delivery space and from there flows via part of the housing 41 into a feed conduit to the internal combustion engine. If a rise of the axial force above a specific value occurs within the pump chamber 5, for example as a result of the settling of dirt particles between the impeller 3 and pump-chamber walls 13, 17, the particular axially displaceable pump part lifts off from the fixed pump part counter to the force of the spring element 31, 45 and thus exposes an orifice cross section, via which the dirt particles can be flushed out. It is thus possible, by means of the spring element according to the invention, for the leakage losses out of the pump chamber 5 to be minimized and for dirt particles between the impeller 3 and pump-chamber walls 13, 17 be flushed out, so that a seizure of the impeller 3 can be reliably avoided in spite of the narrow play relative to the chamber walls.

The foregoing relates to preferred exemplary embodiments of the invention, it being understood that other variants and embodiments thereof are possible within the spirit and scope of the invention, the latter being defined by the appended claims.

We claim:

1. An assembly for feeding fuel from a supply tank to an internal combustion engine, which comprises a feed pump (1) including a disk-shaped impeller (3) which rotates in a cylindrical pump chamber (5), said pump chamber is delimited by a stationary first housing part with a first pump chamber wall (13) forming a suction cover (7,207) and by a stationary second housing part bearing on the latter and forming an intermediate housing (9,209) with a second pump chamber wall (17), and at the same time feeds fuel from a suction port (23) in the suction cover (7,207) to a delivery port (25) in the intermediate housing (9,209), at least one resilient connecting element that connects said suction cover relative to said intermediate housing in such a way that a relative axial movement in relation to an axis of rotation of the impeller (3) is permitted between the suction cover (7,207) and the intermediate housing (9,209).

2. The assembly as claimed in claim 1, wherein the resilient connecting element is inserted under pretension into the feed pump (1).

3. The assembly as claimed in claim 2, wherein the pretensioning force of the resilient connecting element is set in such a way that the pretension is slightly higher than a force acting on the first and second pump-chamber walls (13, 17) as a result of a maximum operating pressure within the pump chamber (5).

4. The assembly as claimed in claim 1, wherein the resilient connecting element is formed by at least one spring clip (31) which is preferably designed as a two-armed angled sheet-metal formed part and of which one arm (35), surrounds the intermediate housing (9), and bears on an outer circumference of the suction cover (7) and another arm (33) is supported on an end face of the intermediate housing (9) facing away from the pump chamber (5).

5. The assembly as claimed in claim 4, wherein recesses (37) receiving the respective arms (35) of the spring clips (31) are provided on the circumferential surface of the suction cover (7), the depth of said recesses increasing continuously in a direction facing away from the intermediate housing (9).

6. The assembly as claimed in claim 4, wherein the suction cover (7) has a cylindrical recess which forms a pump chamber (5) and which is delimited by a remaining ring (15) which projects axially in a direction of the intermediate housing (9) and on an end face of which the disk-shaped intermediate housing (9) is held in bearing contact by the spring clip (31), a delivery space of the feed assembly adjoining the end face of the intermediate housing (9) faces away from the suction cover (7).

7. The assembly as claimed in claim 4, wherein there is provided on the radially outer region of the pump chamber wall (13) formed on the suction cover (7) an annular step (29), the axial dimension of which amounts to a size of half the axial play between the impeller (3) and the pump-chamber wall (13, 17).

8. The assembly as claimed in claim 1, wherein the resilient connecting element is designed as a spring washer (45) which is clamped between a housing (41) of the feed assembly, said housing receiving the feed pump (1), and the suction side of the feed pump (1).

9. The assembly as claimed in claim 8, wherein the spring washer (45) has, on an end face facing the suction cover (207), axially projecting spring tongues (49) which bear under pretension on the end face of the suction cover (207) facing away from the pump chamber (5).

10. The assembly as claimed in claim 8, wherein the intermediate housing (209) has a cylindrical recess which forms the pump chamber (5) and which is delimited by an annular extension (43) which projects axially in the direction of the suction cover (207) and which surrounds the circumferential surface of the disk-shaped suction cover (207) with slight play.

11. The assembly as claimed in claim 10, wherein the spring washer (45) is pressed with a radially outer annular region onto the end face of the annular extension (43) by a collar (47) of the housing (41), the spring tongues (49) coming to bear on the suction cover (207).

12. The assembly as claimed in claim 8, wherein a rib (55) supporting a drive shaft (53) driving the impeller (3) of the feed pump (1) is provided on the end face of the spring washer (45) facing away from the suction cover (207).

* * * * *